US007886376B2

(12) United States Patent
Ray

(10) Patent No.: US 7,886,376 B2
(45) Date of Patent: Feb. 15, 2011

(54) SHOWER CUBE WITH SHAVING BUDDY

(76) Inventor: Kerrie Lynn Ray, 5796 NW. Chesboro Ter., Port Saint Lucie, FL (US) 34986

( * ) Notice: Subject to any disclaimer, the term of this patent is extended or adjusted under 35 U.S.C. 154(b) by 1031 days.

(21) Appl. No.: 11/708,909

(22) Filed: Feb. 20, 2007

(65) Prior Publication Data

US 2008/0196157 A1 Aug. 21, 2008

(51) Int. Cl.
*A47K 3/12* (2006.01)

(52) U.S. Cl. ..... 4/611; 4/574.1

(58) Field of Classification Search ..... 4/254, 4/571.1, 574.1, 578.1, 611
See application file for complete search history.

(56) References Cited

U.S. PATENT DOCUMENTS

D287,075 S * 12/1986 Colin et al. ..... 4/611
5,341,528 A * 8/1994 Sultzbaugh ..... 4/611
5,640,723 A * 6/1997 Stanek ..... 4/578.1
5,920,926 A * 7/1999 Torres ..... 4/574.1

* cited by examiner

*Primary Examiner*—Tuan N Nguyen

(57) ABSTRACT

A shower cube with shaving buddy is used for sitting while in the shower and resting one's leg on the movable shaving buddy or the like, has a sturdy plastic frame with a rubber gripping base. This sturdy plastic frame has a vinyl cushion seat cover which is able to be lifted up to a 90 degree angle at the hinges in order to release the movable shaving buddy. When the cushion seat is up, a large bath supply storage space is accessible with a rubber coated wire base insert. The movable shaving buddy has a rounded vinyl cushion leg rest for easier shaving of ones legs. The shaving buddy also has 2 drawers with rubber coated wire drawer inserts used to store smaller bath and shower storage needs.

7 Claims, 27 Drawing Sheets

Front View

Shower Cube with Shaving Buddy Extended in Shower

Front View

Top View

Top View- Seat Up

Side View

Side View – Seat Up

Back View

Back View – Seat Up

Front View – Seat Up

Top View – Seat Up

Bottom View

Front View – No Shaving Buddy

Front View – Shaving Buddy

Side View – Shaving Buddy

Back View – Shaving Buddy

Top View – Shaving Buddy

Bottom View – Shaving Buddy

Front View – Shower Cube with Shaving Buddy Out

Side View - Shower Cube with Shaving Buddy Extended

Shower Cube with Shaving Buddy Extended in Shower

Side View – Shaving Buddy Drawer

Front View – Shaving Buddy Drawer

Top View – Shaving Buddy Drawer

Top View – Shaving Buddy Drawer with Removable Storage Tray

Top View – Shaving Buddy Drawer with Removable Soap Tray

Removable Drawer Insert

Removable Soap Tray Drawer Insert

Removable Cube Insert

SHOWER CUBE WITH SHAVING BUDDY

BACKGROUND OF THE INVENTION

1. Field of the Invention

The present invention relates to portable shower seats including storage space for such items as razors, shampoo, conditioner, soap, shaving cream and more the like, and particularly, includes a portable rolling leg rest to accommodate shaving one's legs in the shower.

2. Description of Prior Art

Today, the majority of master bathrooms being added to homes, both new and dated include a separate stall from the bathtub for a shower. In today's day and age, where time is of the essence, most women have phased away from taking baths and now take showers. Most stand up shower stalls today lack not only a place to sit down to relax while bathing, but they also lack storage facilities for extra shampoo, shaving supplies and bar soap. Shaving one's legs in the shower can also be a hassle for there is no place to put your foot or legs. The shower cube with shaving buddy takes care of these issues.

There are many seats and benches that have been given patent in the U.S. such as U.S. Pat. Nos. 6,065,251; 6,681,415; 5,185,892; and 5,590,427. Most of these items are targeted towards the elderly or handicap. Other problems with these inventions include the difficulty of mounting and demounting the units. There is even a seat developed as a storage devise such as U.S. Pat. No. 592,786. The problem with this invention is it lacks eye appeal, enough space for all shower products, a comfortable seat and a place to rest your legs while shaving them.

Stand alone foot supports have also been invented such as U.S. Pat. Nos. 4,489,448; 5,341,528; and Des. 287,075. There are also stand alone shower organizers such as U.S. Pat. No. US D 446,670 S.

SUMMARY OF THE INVENTION

The goal of the invention is to provide a stylish, compact, high quality, sturdy product that provides a place in the shower to sit down, shave one's legs comfortably, store extra bathing supplies and rest the foot, all in one product. The shower cube is easily added to any shower. The cube is made out of solid plastic with a rubber base to prevent slipping. The shower cube comes with a main unit in the shape of a cube (less the hollow area where the shaving buddy stays while the shower cube is in its original position). There is a seat a cushion which is vinyl and waterproof that lifts to reveal the inner storage unit for such items as shaving cream, shampoo, conditioner or shower gel. The shaving buddy rests underneath the cushion seat when the shower cube sits in original position. To slide the shaving buddy out to rest one's legs, lift the cushion, release the wheels with the wheel latch, slide the shaving buddy out, secure the wheels, secure the shaving buddy. The shaving buddy is a sturdy leg rest that is topped with vinyl cushion for comfort. The shaving buddy contains 2 drawers with locations of extra bar soap, razors or anything else you want to keep in this rubber sealed storage drawer.

DETAILED DESCRIPTION OF THE PREFERRED EMBODIMENTS

Figure 1:
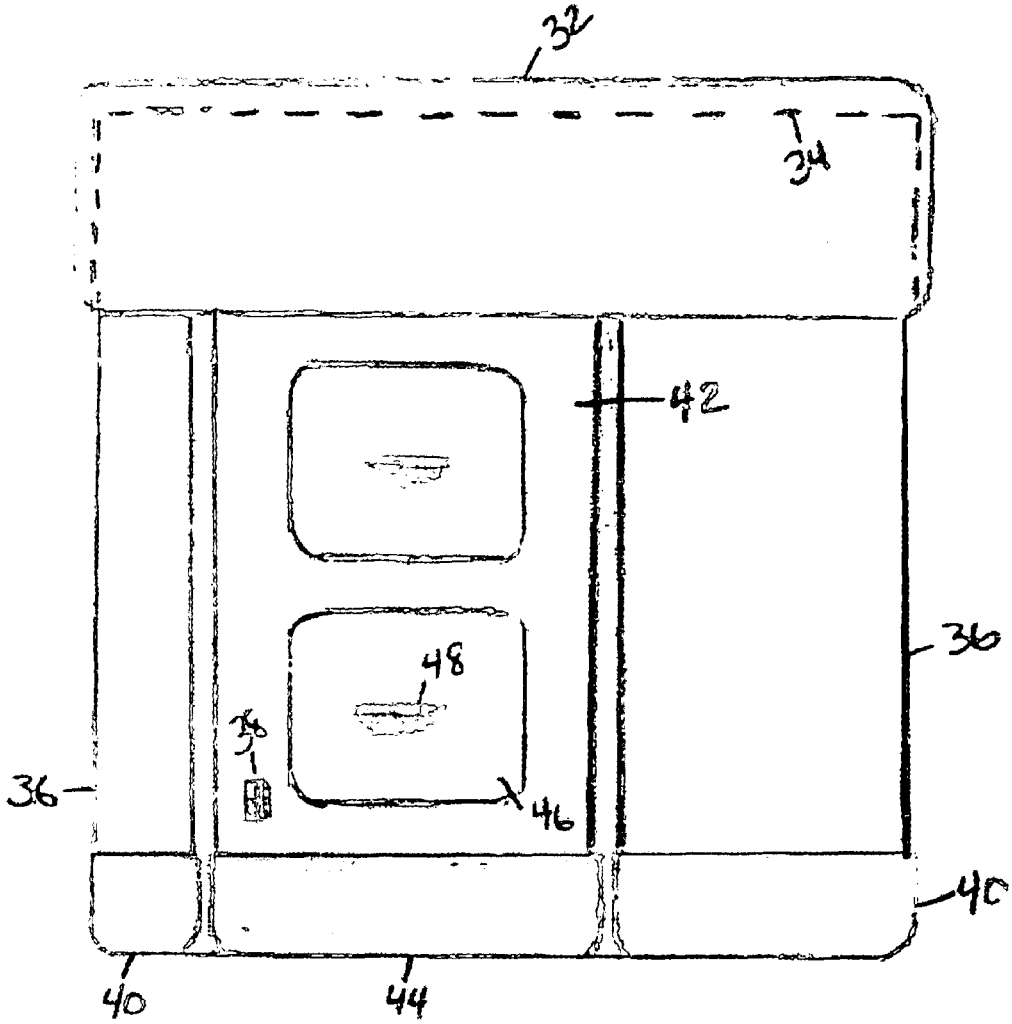
FIG. 1 is the front view of the shower cube with the shaving buddy in its original position.
Figure 2:
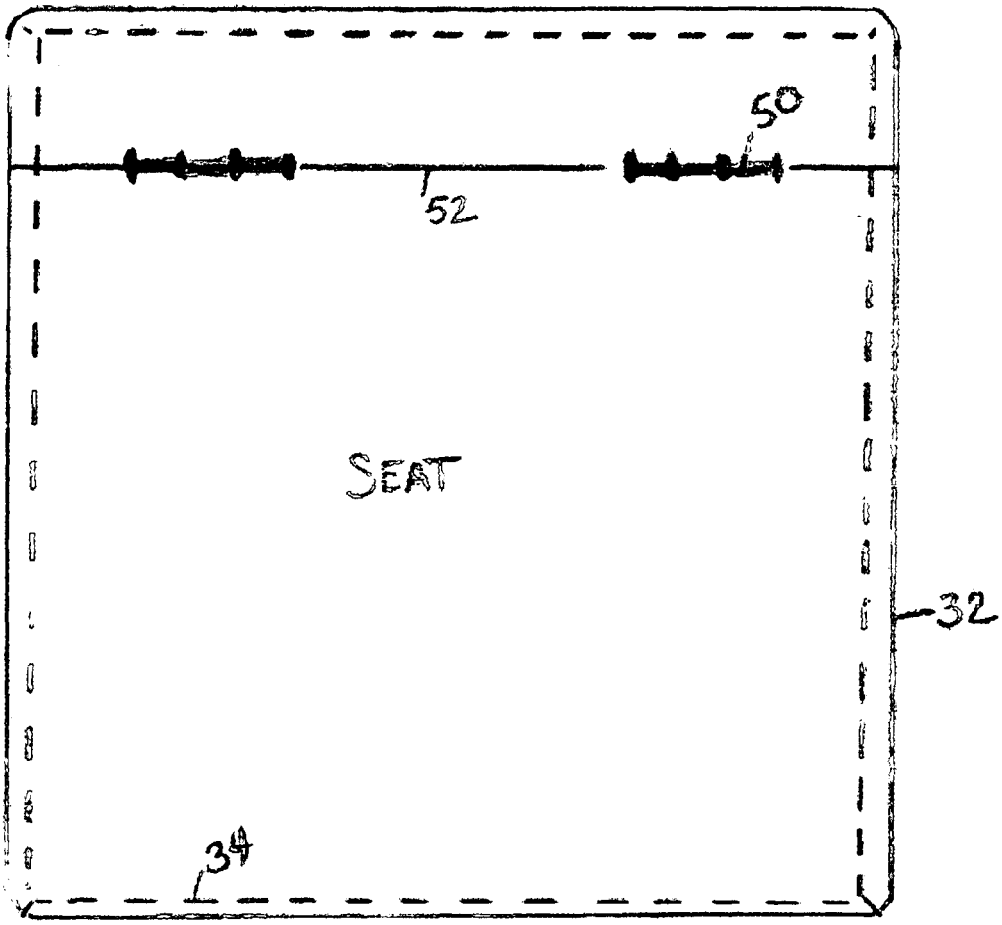
FIG. 2 is an overhead view of the shower cube looking directly down on the waterproof vinyl seat.
Figure 17:
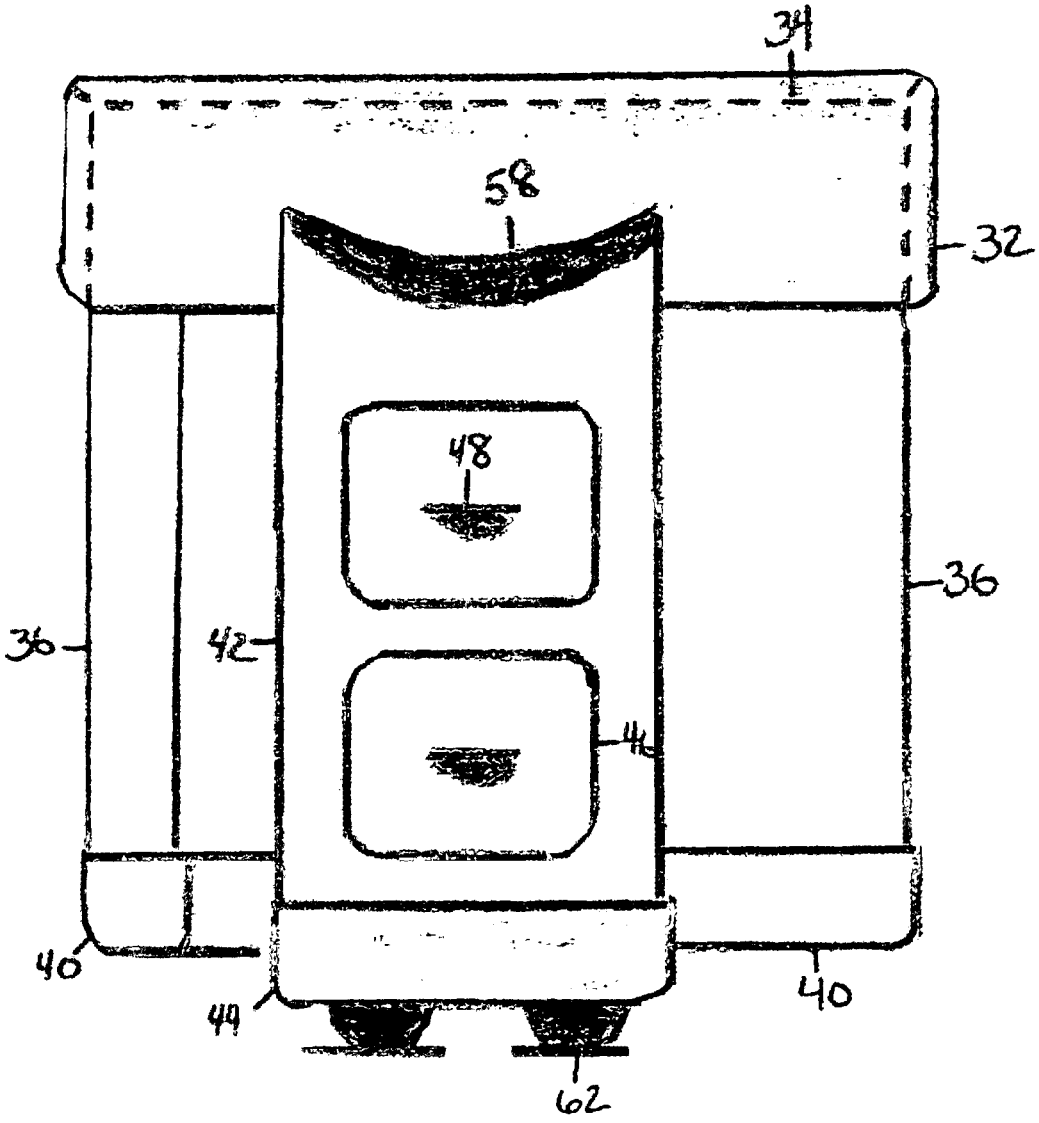
FIG. 17 is the front view of the shower cube with shaving buddy in its extended position with wheels out.
Figure 18:
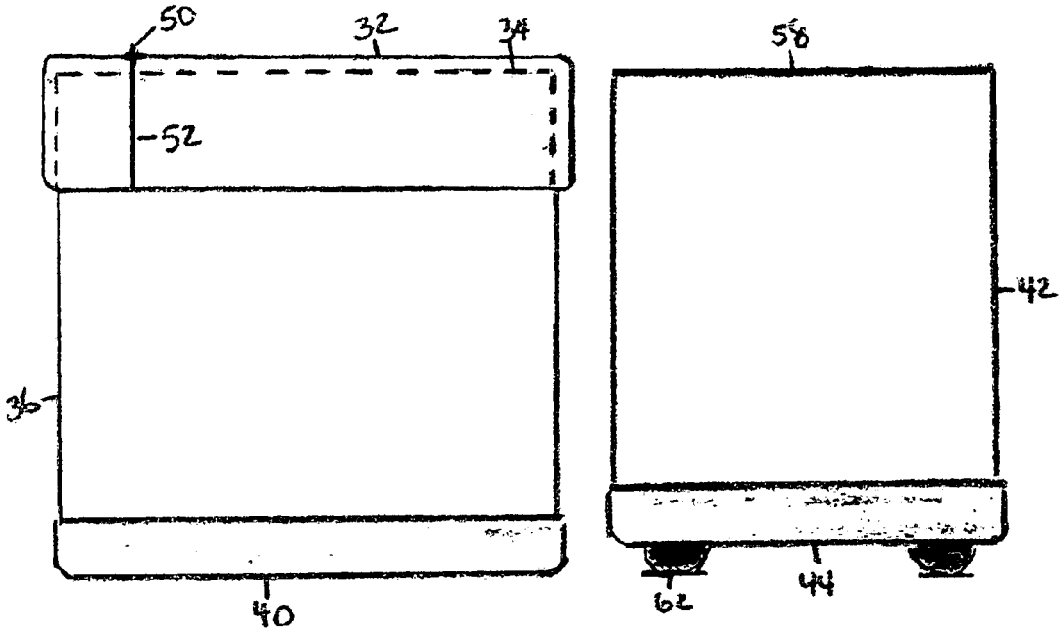
FIG. 18 is the side view of the shower cube with shaving buddy in its extended position with wheels out.
Figure 19:
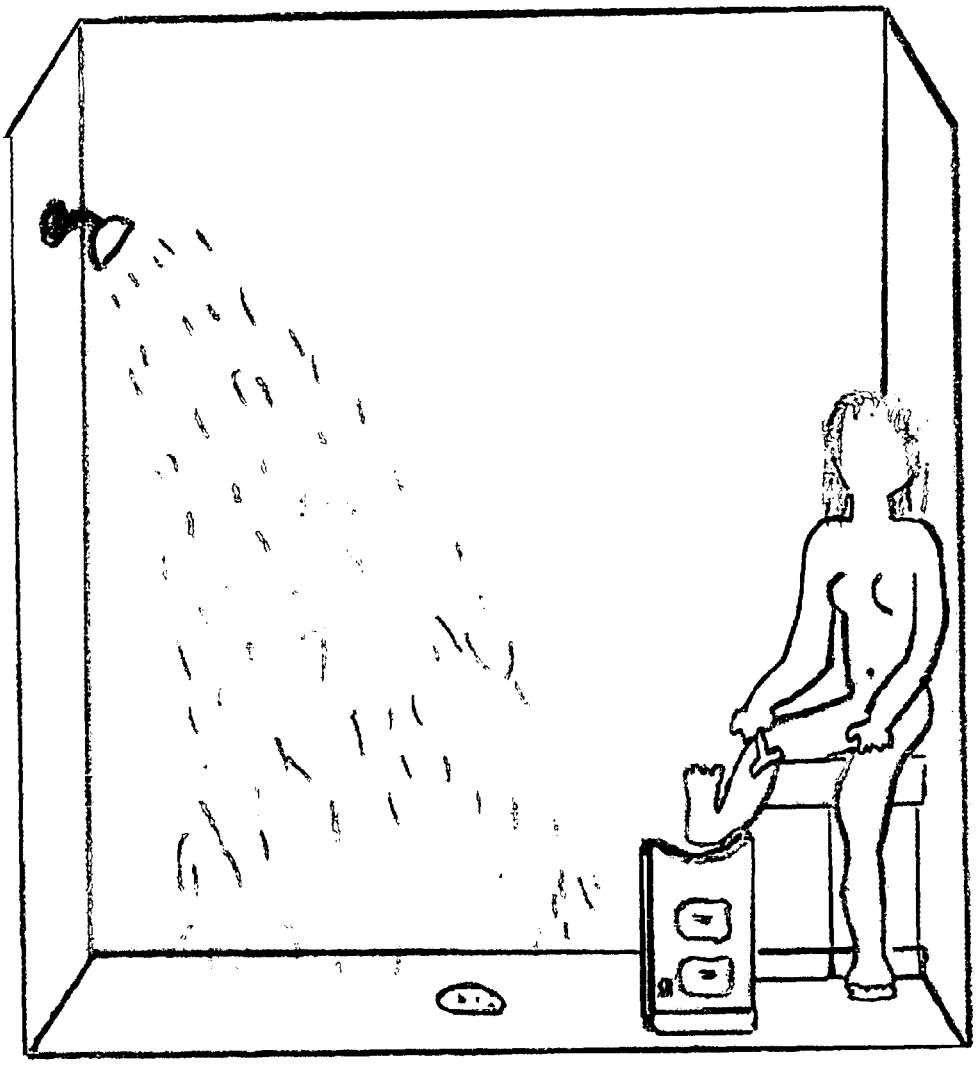
FIG. 19 is the front working view of the shower cube with shaving buddy positioned within the shower.

Referring now to the drawings, specifically FIG. 19, there is shown the shower cube with shaving buddy in its working position within a stand alone shower stall. As hereinafter described, the shower cube with shaving buddy is moveable between the all in one cube best seen in FIG. 1 and 8 and the extended position seen in FIG. 17, 18 and 19.

The shower cube with shaving buddy includes a main frame 36, a seat cover 32, a rubber cube base 44, a rubber coated wire storage area 56 and the main shaving buddy 42 with storage drawers 46 that include removable rubber coated wire drawer insert 70 and soap tray 56 as well as retracting wheels 62.

Referring now to the main shower cube, the body 36 is made out of a smooth, sturdy plastic material, that can withstand a large amount of weight. The body 36 has rounded edges. The main body is in the shape of a cube with a cut-out opening 54 located on the left side of the cube when looking directly at it. Drawings that best describe this are FIGS. 3, 10 and 11.

Figure 3:
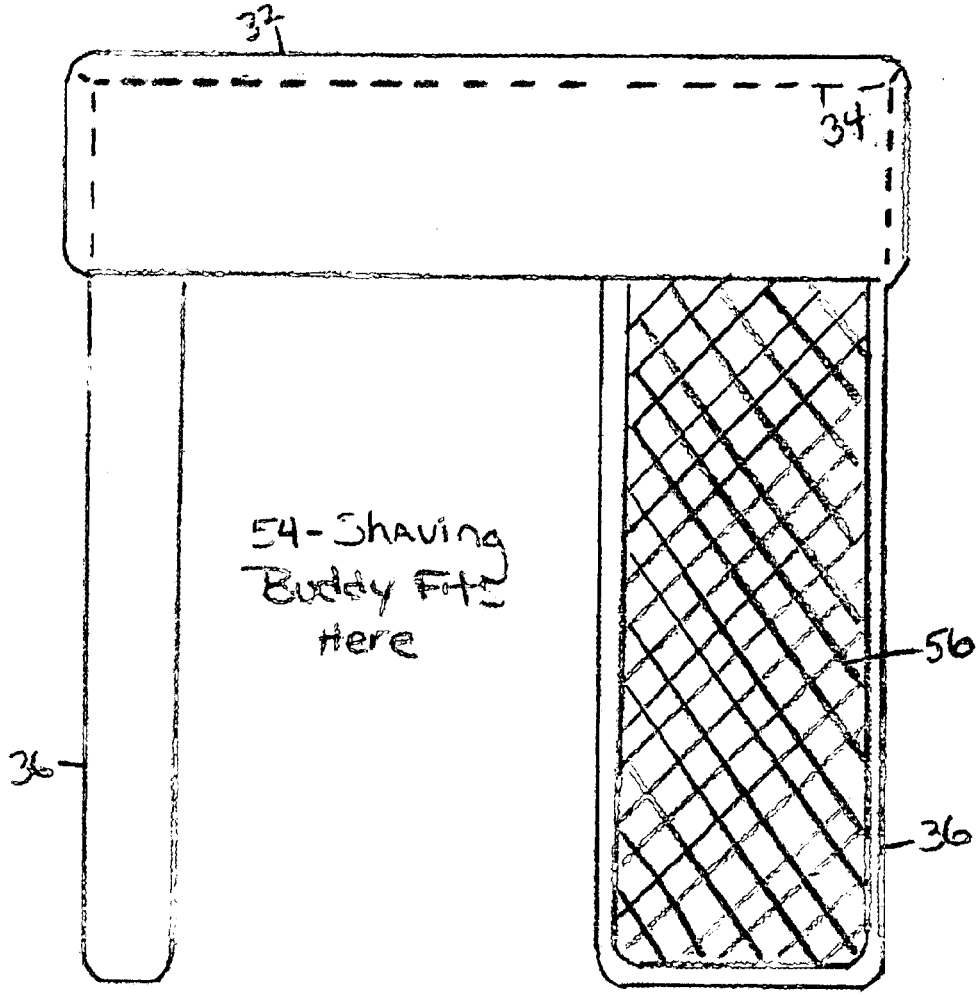
FIG. 3 is an overhead view of the shower cube with the vinyl seat up, allowing the viewer to see the inside storage unit along with the Water and ventilation grate at the bottom, as well as the spot in which the shaving buddy rests.
Figure 4:
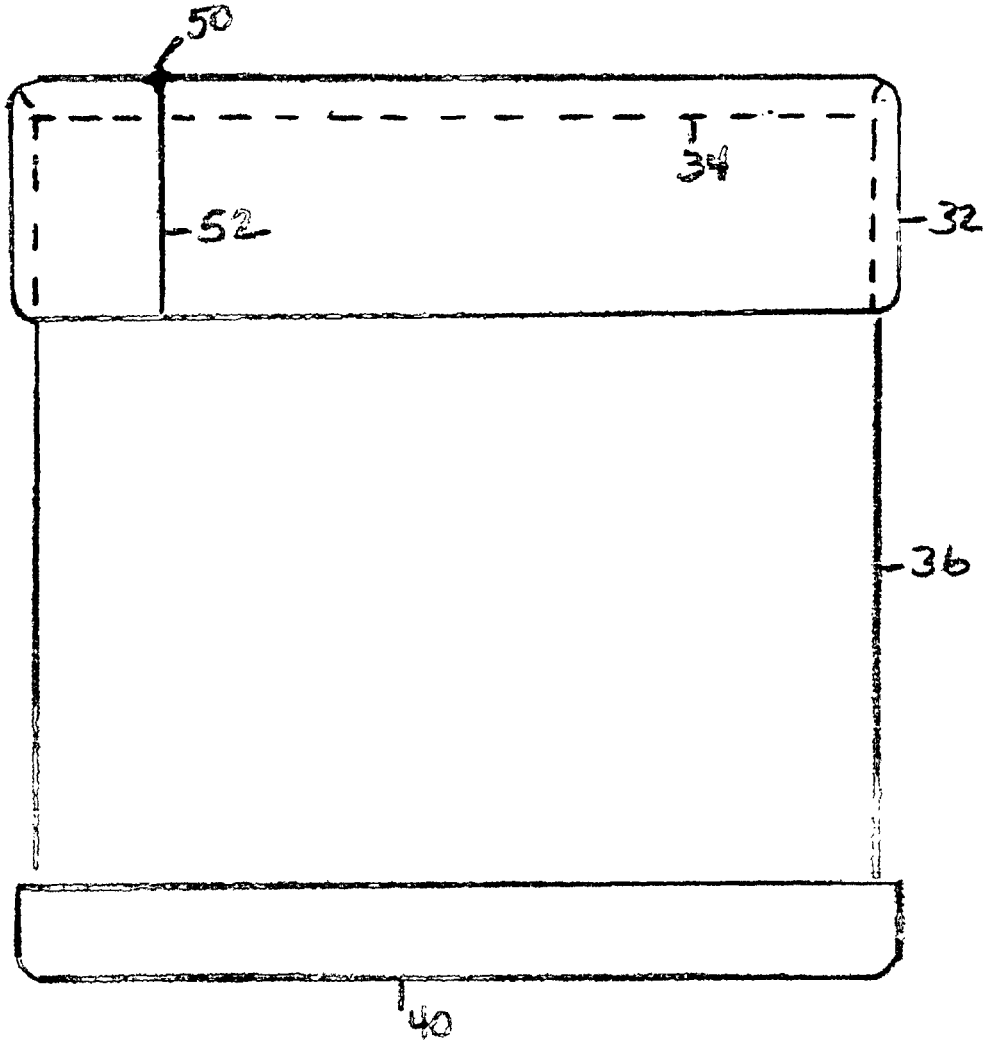
FIG. 4 is a side view of the shower cube with the seat down.
Figure 5:
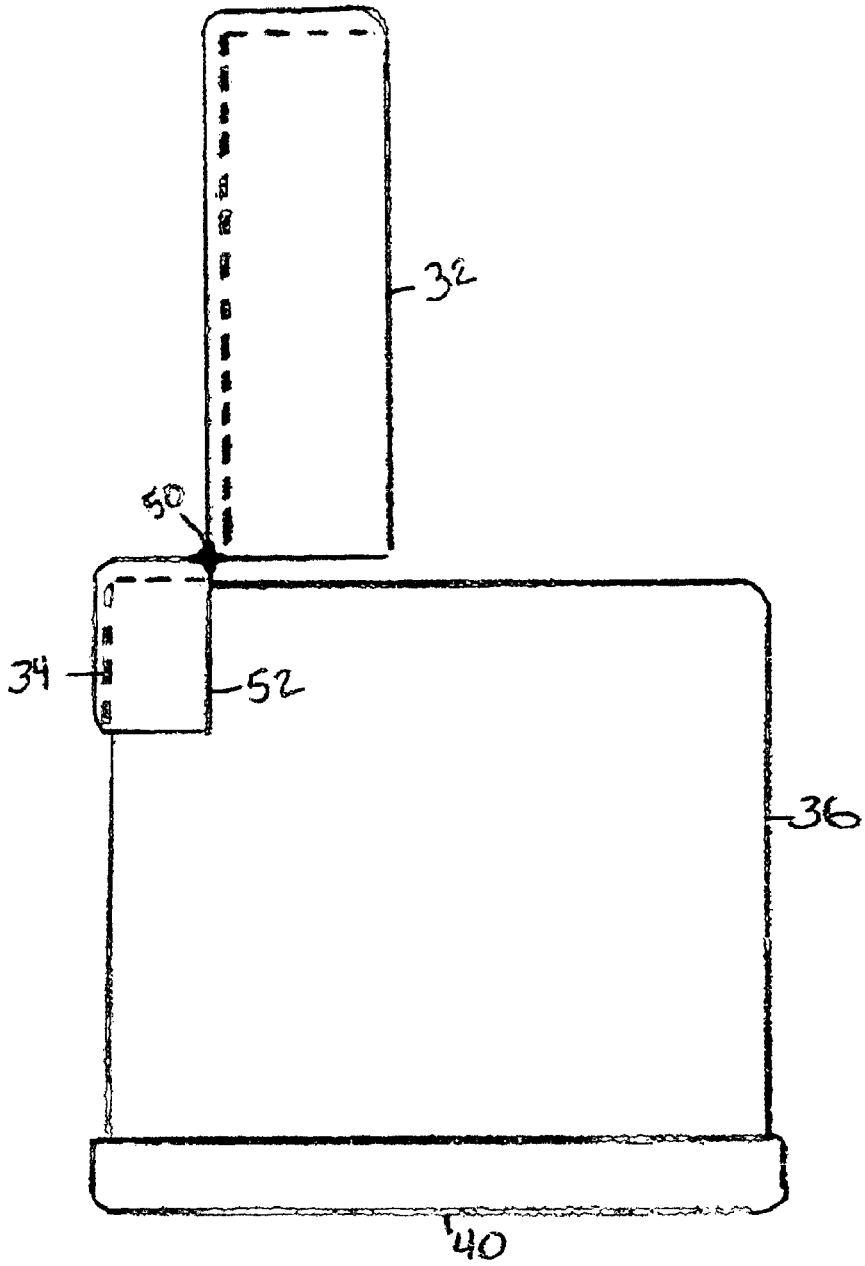
FIG. 5 is a side view of the shower cube with the seat up.
Figure 6:
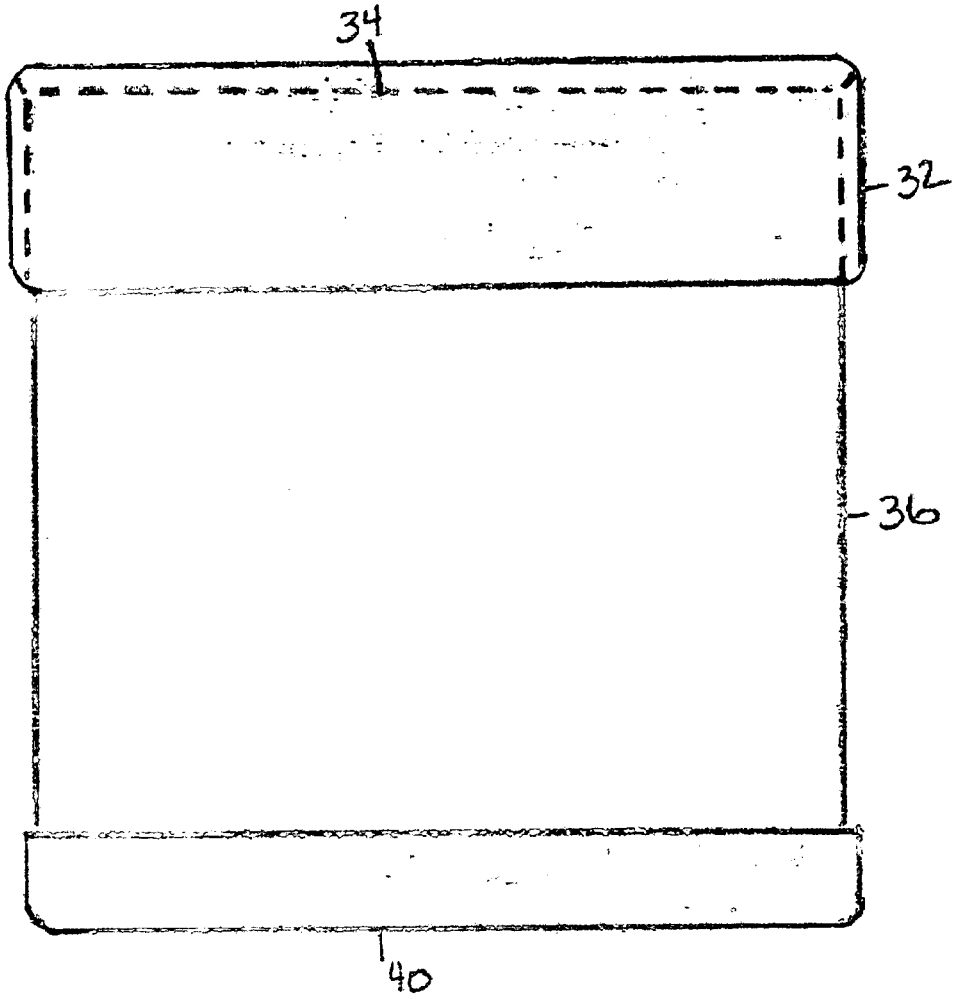
FIG. 6 is the rear view of the shower cube with the seat down.
Figure 7:
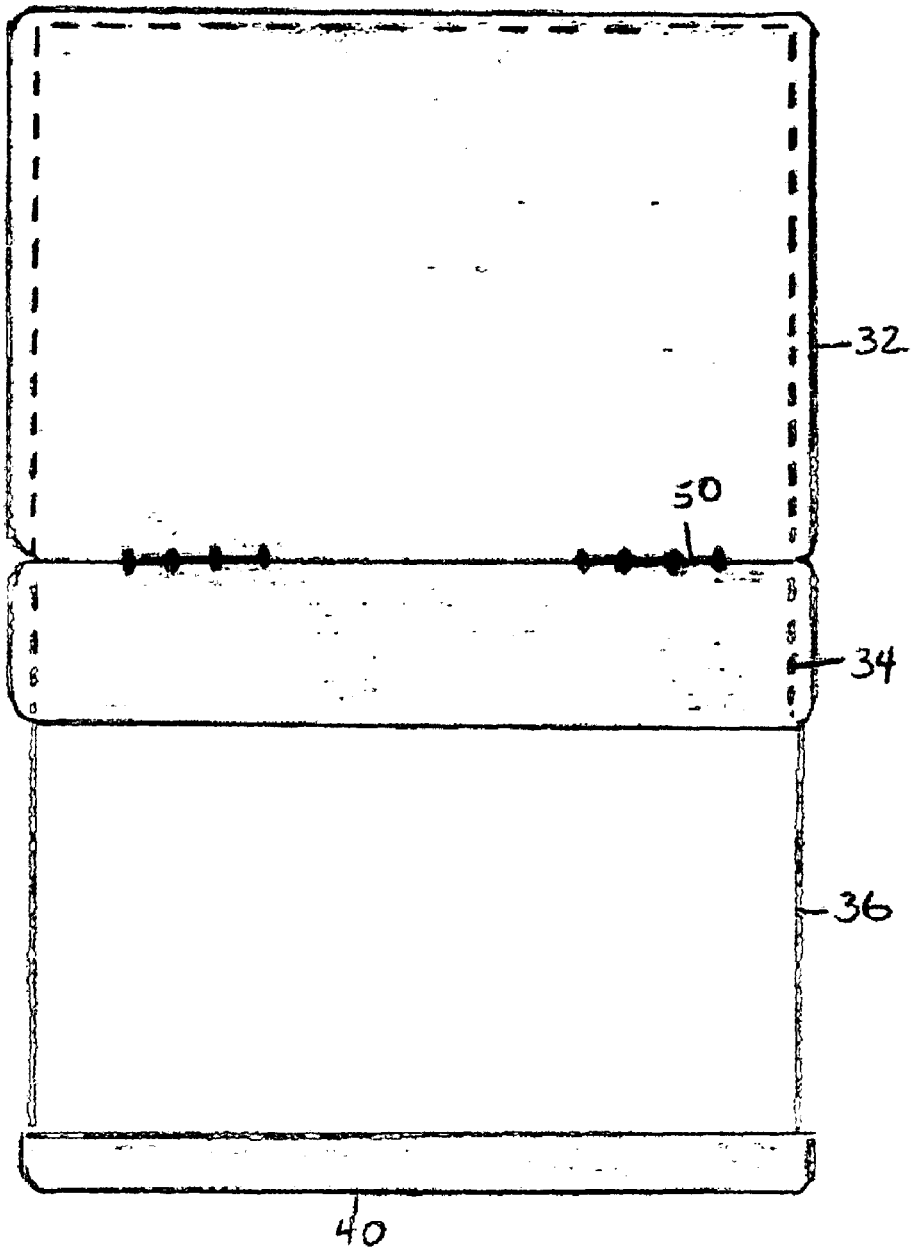
FIG. 7 is the rear view of the shower cube with the seat up.
Figure 8:
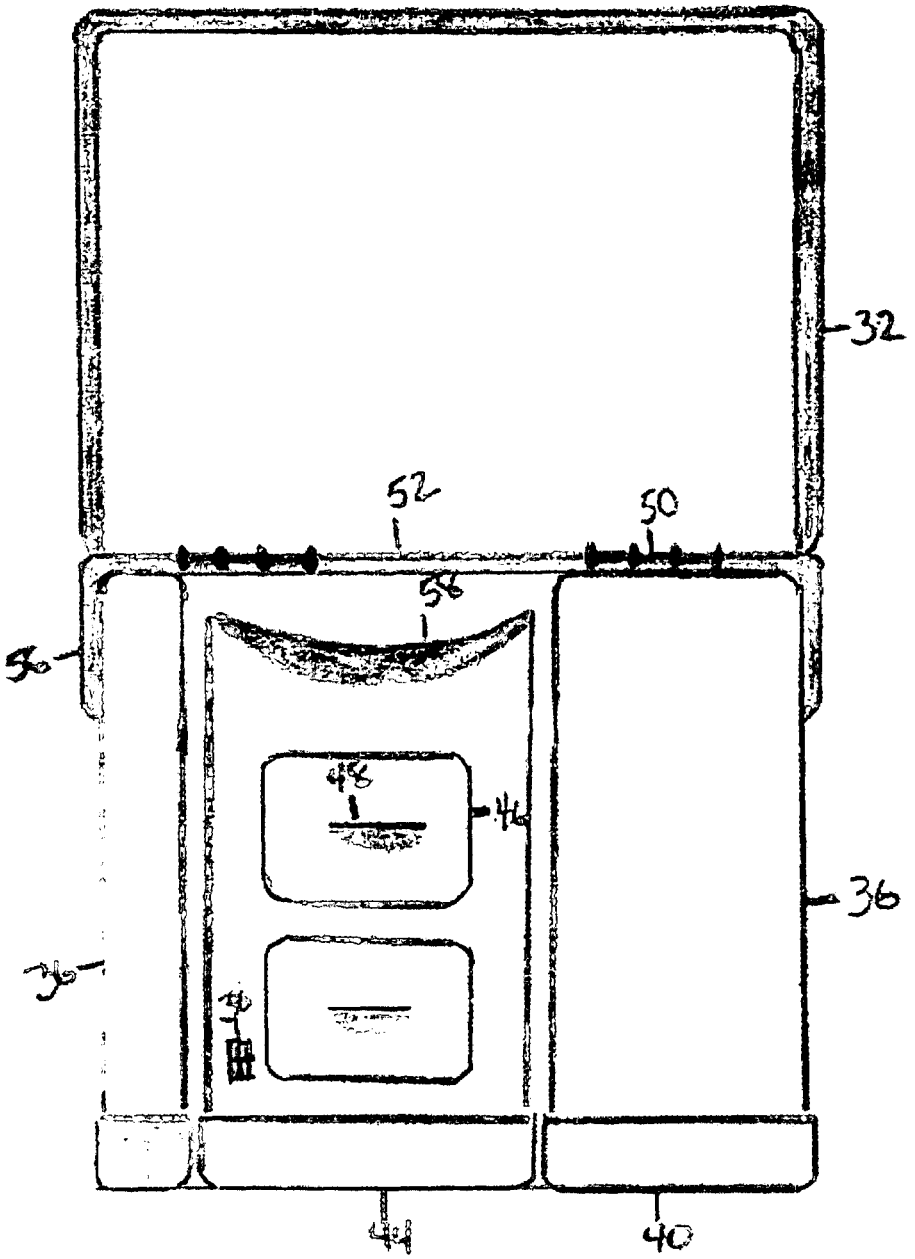
FIG. 8 is the front view of the shower cube with the seat up with the shaving buddy in its original position.
Figure 9:
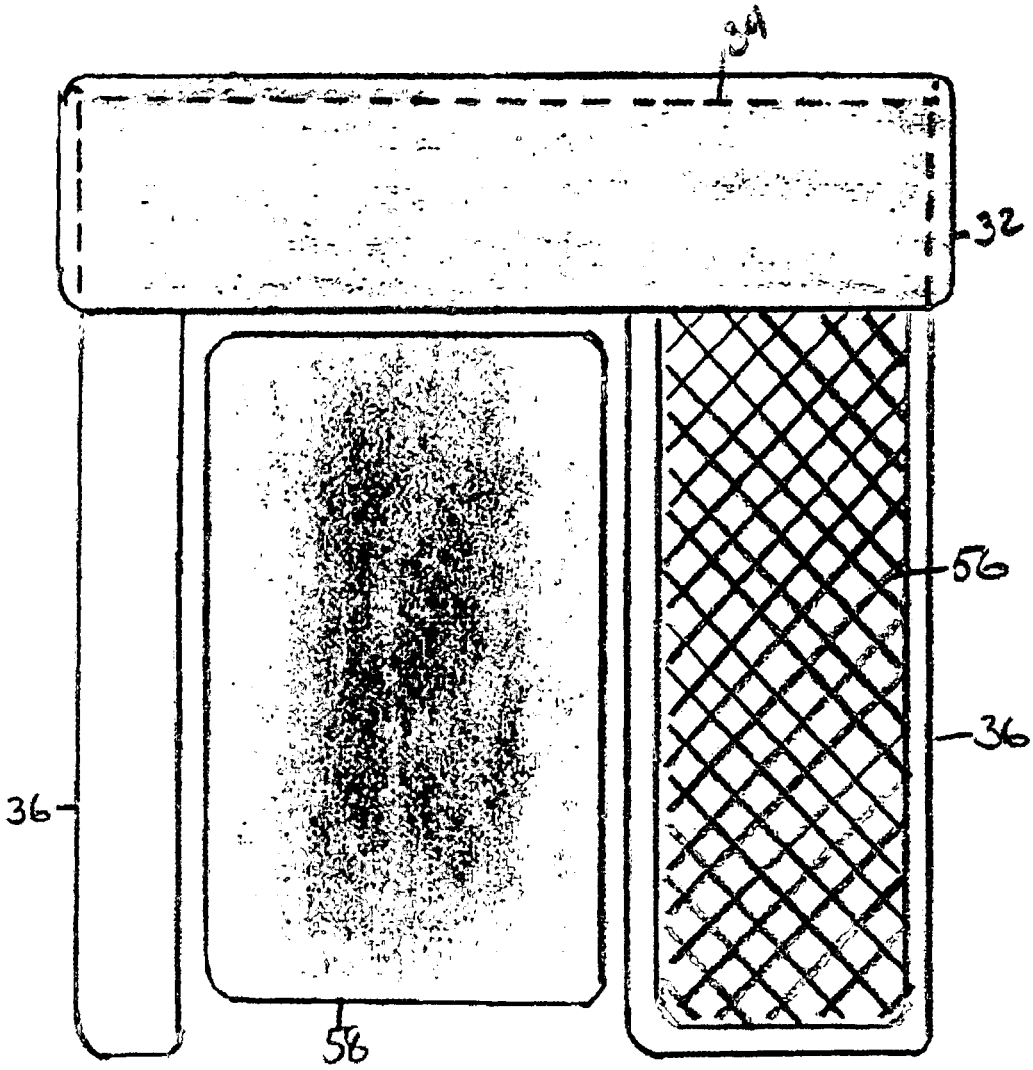
FIG. 9 is the overhead view of the shower cube with the seat up with the shaving buddy in its original position.
Figure 27:
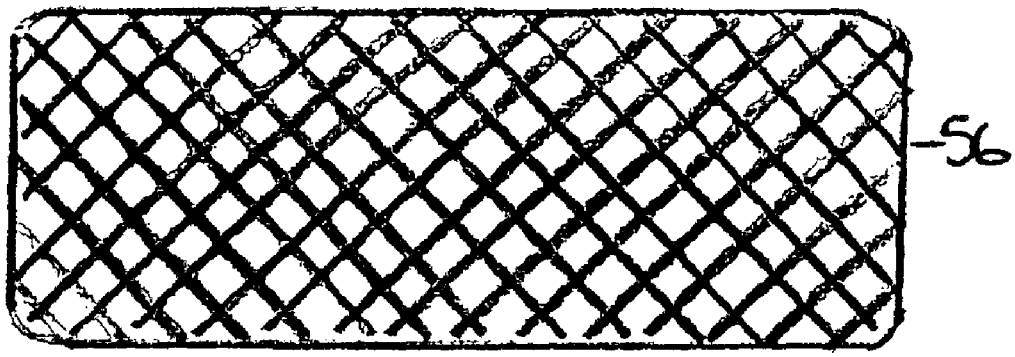
FIG. 27 is the top view of the rubber coated wire removable cube insert for storage section.

Attached to the main body 36, seen specifically in FIGS. 2, 5, 7 and 8, is the waterproof, vinyl seat cushion 32. The cushion is in the shape of a square and is attached to the main unit at the back of the cube. The vinyl seat cushion has decorative seam stitching 34, best seen in FIG. 2. The vinyl seat cushion 32 can be lifted at a 90 degree angle from the main cube body 36, seen in FIGS. 5, 7 and 8 by the two hinges 50 at seam 52. Lifting the cushion 32 reveals the internal storage area where the removable rubber coated wire cube insert 56 is located, as seen in FIGS. 3 and 9. The internal storage space consists of a deep rectangular area, perfect for storing items such as extra shampoo or conditioner bottles, shaving cream or shower gels. As seen best in FIG. 27, the removable rubber coated wire cube insert 56 fits perfectly into the storage area. By making this piece removable, it allows for easy cleaning. Lifting the cushion also allows one to remove the shaving buddy into its extended position as seen in FIG. 8.

Figure 10:
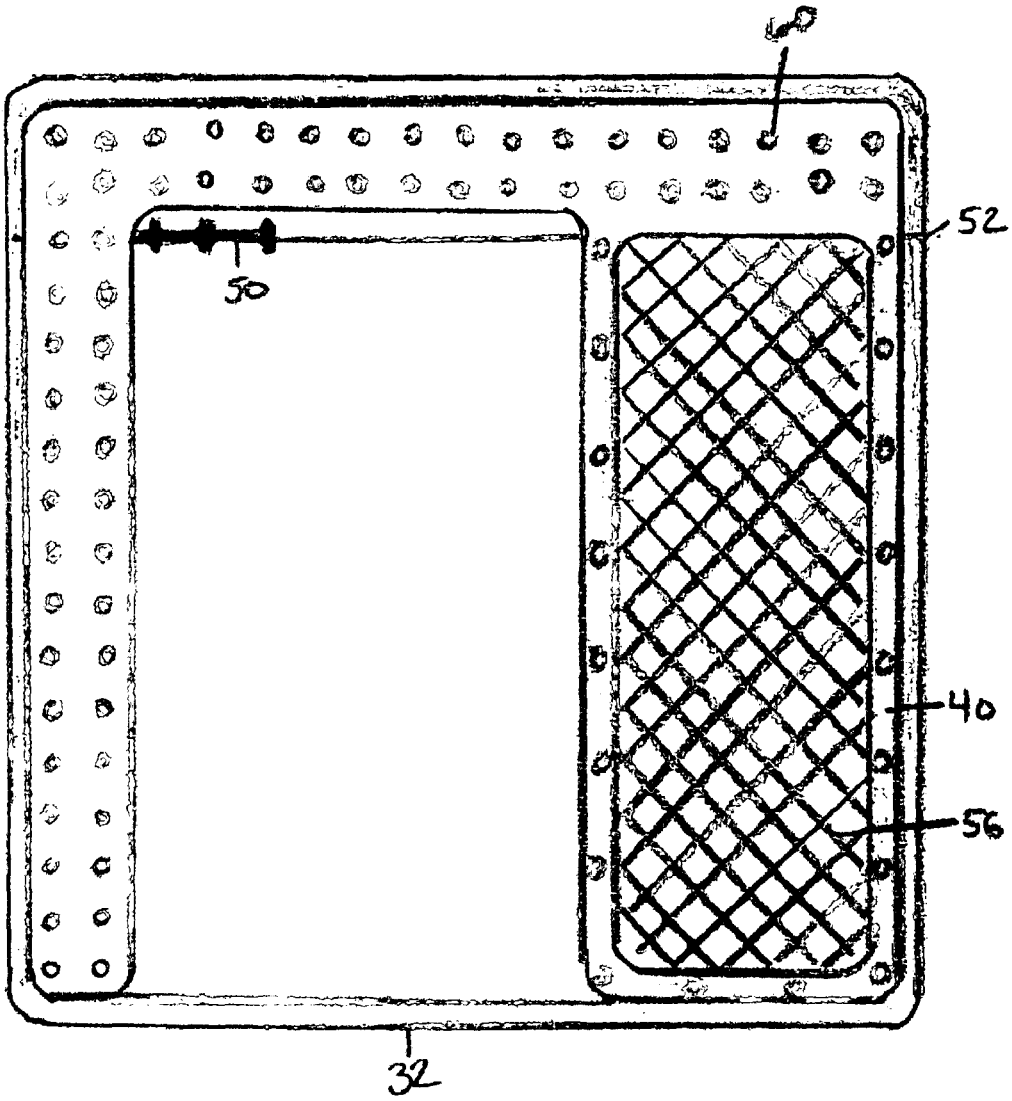
FIG. 10 is the bottom view of the shower cube with the seat down.
Figure 11:
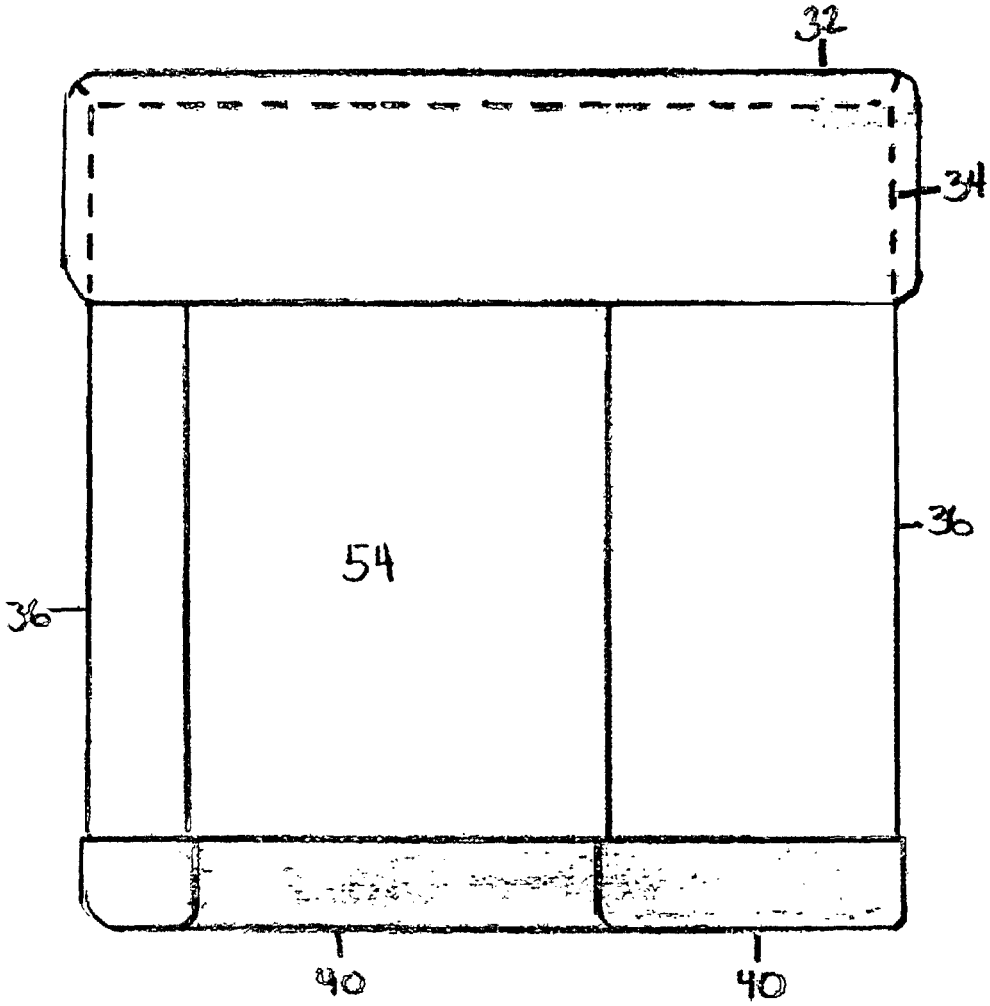
FIG. 11 is the front view of the shower cube with the seat down without shaving buddy.
Figure 12:
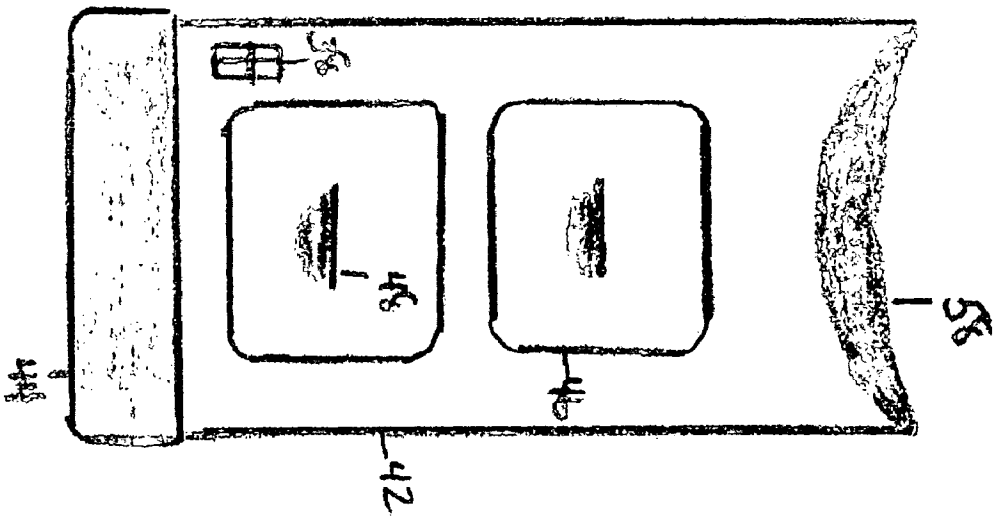
FIG. 12 is the front view of the shaving buddy.
Figure 13:
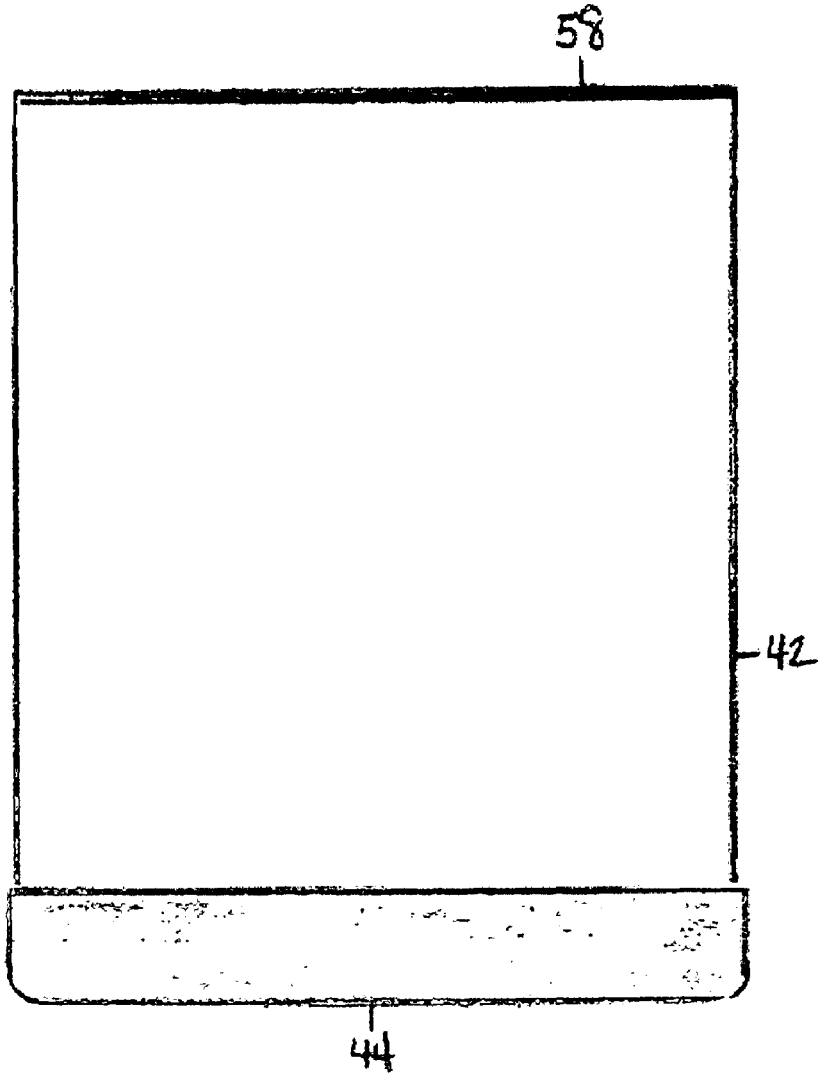
FIG. 13 is the side view of the shaving buddy.
Figure 14:
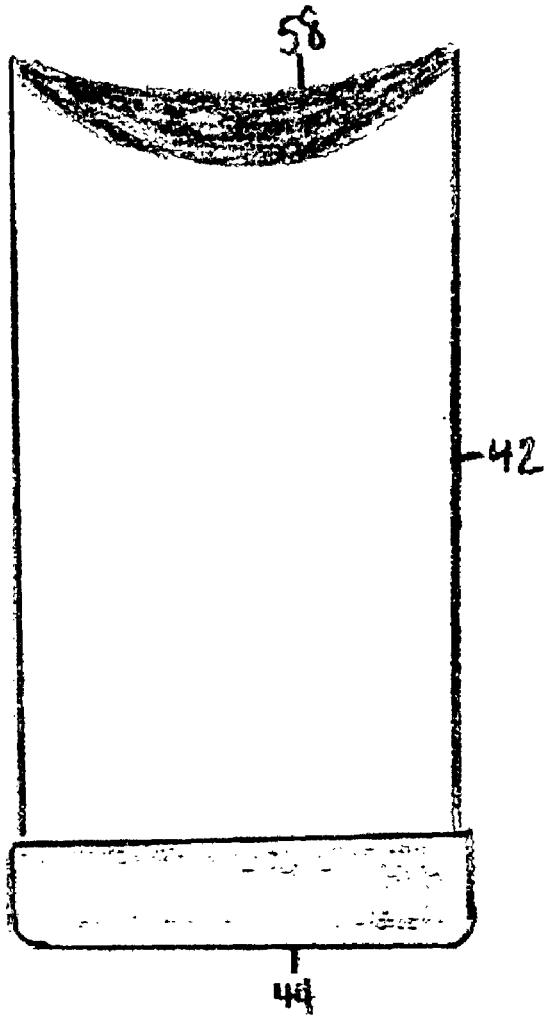
FIG. 14 is the back view of the shaving buddy.
Figure 15:
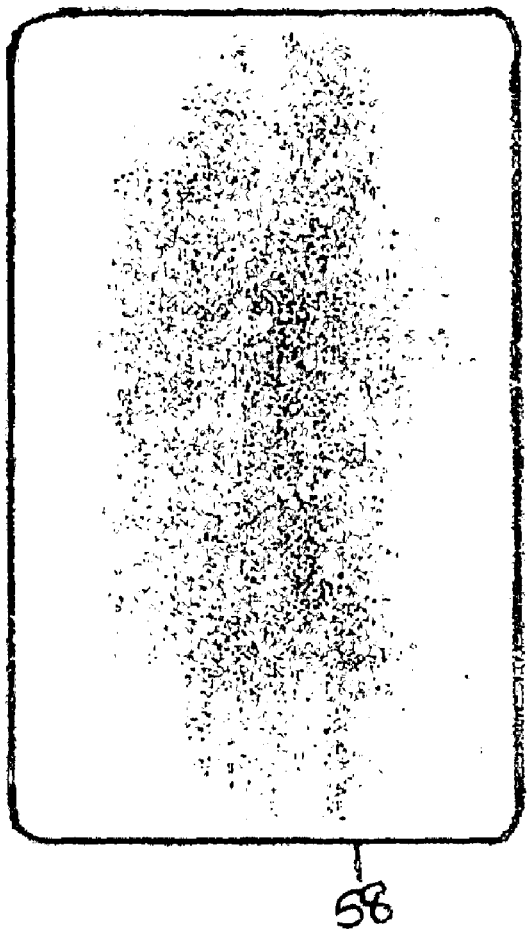
FIG. 15 is the overhead view of the shaving buddy.

The main body of the shower cube 36 has a rubber trim 40 that coats the bottom of the front, back and side edges seen in FIGS. 1, 4, 5, 6, 7, 8, 11, 17 and 19. The rubber coating is also contained on the bottom to prevent slipping in the shower. Attached to the rubber coating on the bottom of the cube are suction cups 60 for added slip support. The bottom of the cube with the rubber base and suction cups is best seen in FIG. 10.

Figure 16:
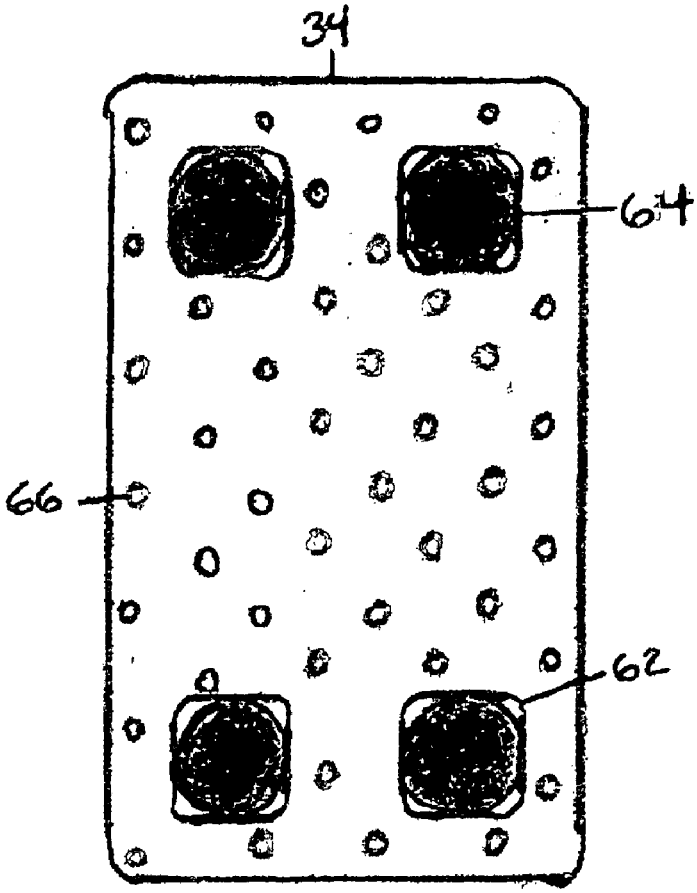
FIG. 16 is the bottom view of the shaving buddy.

Now referring to the shaving buddy 42, best seen in FIGS. 1, 8, 9, and 12-19, you will see the most unique component of the shower cube. The main frame of the shaving buddy 42 stands just short of the main unit and is formed out of the same sturdy molded plastic as the main shower cube frame 36. The base of the shaving buddy is consistent with the base of the main shower cube, with the rubber trim 44 that coats the bottom of the front, back and side edges best seen in FIGS. 1, 8, 12-14 and 16-19. FIG. 16, the best view of the shaving buddy from the bottom, shows the rubber suction base with retractable wheels. The wheels are extended or retracted from wheel base 64 by switch 38 seen on the front of the shaving buddy in FIGS. 1, 8, 12, 17 and 19. The top of the shaving buddy 58, seen in FIGS. 8, 9, 12, 14, 15, 17 and 19 is made out of the like material of the seat cushion, a waterproof, vinyl fabric and is in the shape of a moon crest for comfort when resting one's leg to shave.

Figure 20:
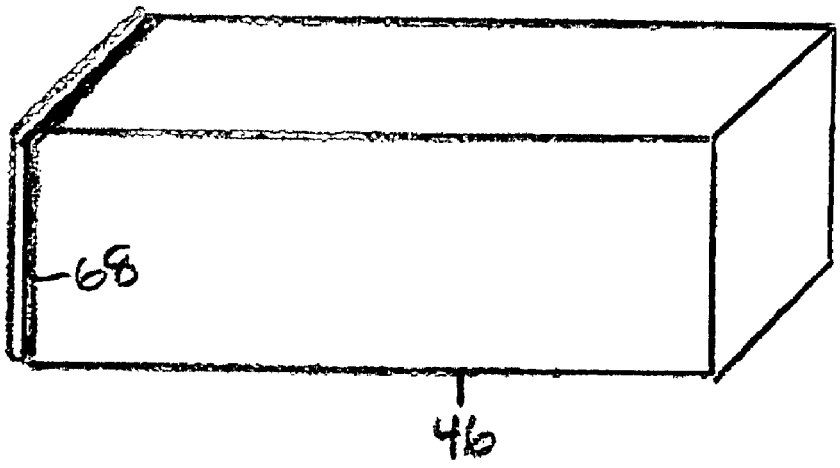
FIG. 20 is the side view of the shaving buddy drawer.
Figure 21:
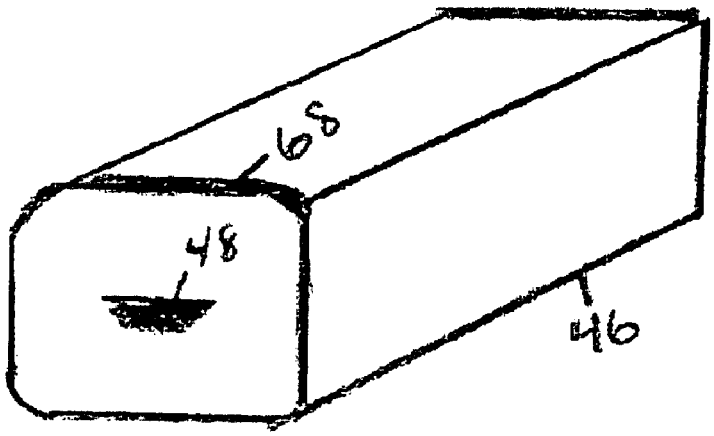
FIG. 21 is the front angled view of the shaving buddy drawer.
Figure 22:
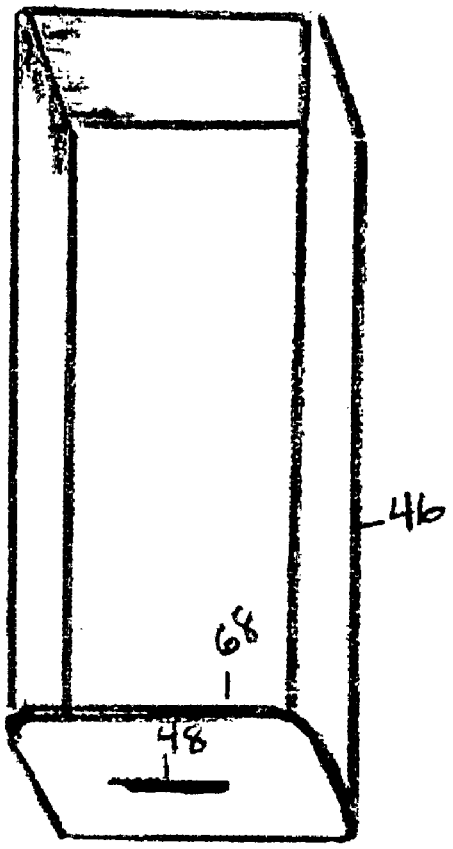
FIG. 22 is the top view of the shaving buddy drawer.
Figure 23:
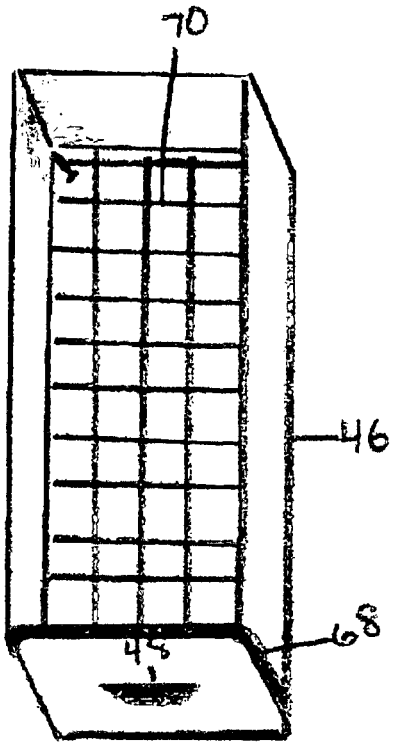
FIG. 23 is the top view of the shaving buddy drawer with removable rubber coated wire storage tray.
Figure 24:
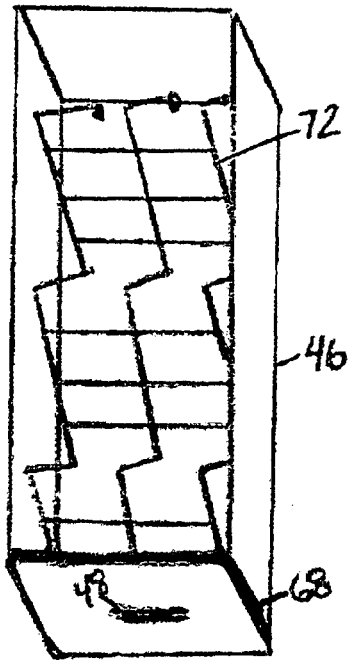
FIG. 24 is the top view of the shaving buddy drawer with removable rubber coated wire soap tray.
Figure 25:
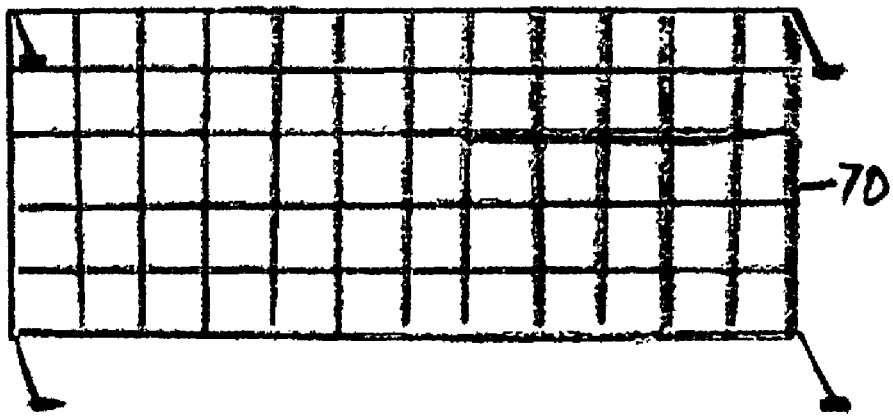
FIG. 25 is the top view of the removable rubber coated wire storage tray.
Figure 26:
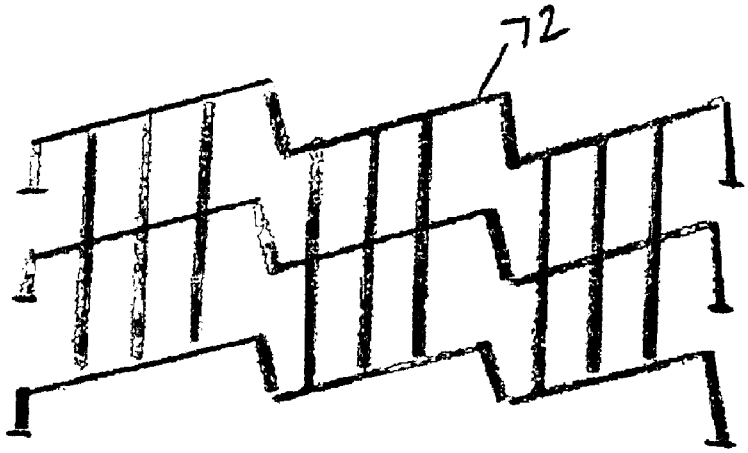
FIG. 26 is the top view of the removable rubber coated wire soap tray.

Included in the shaving buddy are two storage drawers 46, seen in FIGS. 1, 8, 12, 17 and 19-24. Each drawer 46 is similarly shaped. The edges on the front of the drawer are rounded. Handles, 48 are molded into the plastic on the front panel of each of the drawers. A rubber band trim 68 sealing the front of the drawer to the main shaving buddy is seen in FIGS. 20-22 to keep moisture from penetrating into the storage area. Each drawer has a different, removable rubber coated wire tray. FIGS. 23 and 24 show the trays within the drawers. Tray 70, seen in FIGS. 23 and 25 is lifted a little from the base of the drawer and has a grid surface to hold items such as razors, brushes, etc. Tray 72, seen in FIGS. 24 and 26 is also lifted from the base of the drawer, more in the back than in the front. There are three locations on the flat surfaces with a diagonal slope, to house extra soap. Both trays can be easily removed for fast cleanup.

Taking into account that certain changes may be made to the invention that do not take away from or ad to what is intended to be depicted, use the drawings and stated description to merely illustrate what is trying to be shown rather than in a limiting way.

I claim that:

1. A shower cube with a shaving buddy, said cube comprising of:

(a) a sturdy plastic solid frame;

(b) a vinyl seat cushion mounted to said frame, said seat cushion movable by a 90 degree angle to said frame supported by mounting brackets in order to allow the shaving buddy to extend into working position;

(c) a rubber base secured to said frame with rubber suction cups to support said frame in a shower stall;

(d) a removable wire coated rubber cube insert acting as the bottom of the main frame in the storage area to allow water to escape or evaporate from inside the frame unit;

(e) the shaving buddy insert to the frame, also made up of a sturdy plastic material, with a curved vinyl leg support cushion and a rubber base with suction cups to secure the shaving buddy to a shower floor;

(f) a set of extendable wheels on said shaving buddy to easily move buddy from storing position to full working order in its extended position; and, (g) two removable storage drawers within said shaving buddy with removable rubber coated wire drawer inserts.

2. The shower cube as claimed in claim 1, wherein said moveable shaving buddy allows one to shave their legs comfortably while sitting on the cube and placing the leg on the buddy.

3. The shower cube as claimed in claim 1, wherein said removable drawers of said shaving buddy provide a storage for storing soap, razors, and shaving cream items.

4. The shower cube as claimed in claim 1, wherein said main frame has a storage space for larger bath product items such as shampoo and conditioner bottles.

5. The removable drawers as claimed in claim 1, wherein said removable rubber coated wire drawer inserts provide a little breathing space where bath supplies reduce the risk of mildew and rust.

6. The shower cube as claimed in claim 1, wherein said frame and said vinyl seat cushion is able to hold the weight of a 350 lb person comfortably.

7. The shower cube as claimed in claim 1, wherein said vinyl seat cushion and shaving buddy with removable drawers forms a compact cubic shape for easy storage and convenient placing within a shower stall.

* * * * *